US005289251A

United States Patent [19]

Mandel et al.

[11] Patent Number: 5,289,251

[45] Date of Patent: Feb. 22, 1994

[54] TRAIL EDGE BUCKLING SHEET BUFFERING SYSTEM

[75] Inventors: Barry P. Mandel, Fairport; Charles D. Rizzolo, Rochester; Gerald A. Buddendeck, Penfield, all of N.Y.

[73] Assignee: Xerox Corporation, Stamford, Conn.

[21] Appl. No.: 65,099

[22] Filed: May 19, 1993

[51] Int. Cl.[5] ..... G03G 21/00

[52] U.S. Cl. ..... 355/324; 270/59; 355/321

[58] Field of Search ..... 355/321, 322, 324, 309; 270/58, 59

[56] References Cited

U.S. PATENT DOCUMENTS

| | | | |
|---|---|---|---|
| 2,979,330 | 4/1961 | Weber | 271/36 |
| 3,611,436 | 10/1971 | Rigrod | 350/160 |
| 3,636,838 | 1/1972 | Chang et al. | 354/3 |
| 3,809,806 | 5/1974 | Walker et al. | 346/108 X |
| 3,882,744 | 5/1975 | McCarroll | 83/262 |
| 4,231,567 | 11/1980 | Ziehm | 271/259 |
| 4,257,053 | 3/1981 | Gilbreath | 346/108 |
| 4,386,827 | 6/1983 | Scifres et al. | 350/356 |
| 4,511,297 | 4/1985 | Wilson et al. | 355/324 |
| 4,551,732 | 11/1985 | Rogers | 346/108 X |
| 4,627,711 | 12/1986 | Schron | 355/208 |
| 4,768,043 | 8/1988 | Saito et al. | 346/108 |
| 4,786,041 | 11/1988 | Acquaviva | 271/3.1 |
| 4,801,134 | 1/1989 | Yokoyama et al. | 271/122 |
| 4,835,545 | 5/1989 | Mager et al. | 346/108 X |
| 4,837,636 | 6/1989 | Daniele et al. | 358/300 |
| 5,008,713 | 4/1991 | Ozawa et al. | 355/319 |
| 5,012,296 | 4/1991 | Dinnissen et al. | 355/320 |
| 5,045,868 | 9/1991 | Tajima | 346/108 |
| 5,049,897 | 9/1991 | Ng | 346/108 X |
| 5,051,757 | 9/1991 | Hasegawa | 346/108 |
| 5,055,860 | 10/1991 | Bannai | 346/108 |
| 5,058,879 | 10/1991 | Dunaway | 271/259 |
| 5,083,761 | 1/1992 | Johdai et al. | 271/3.1 |
| 5,083,769 | 1/1992 | Young, Jr. | 271/280 |
| 5,112,034 | 5/1992 | Uto et al. | 270/58 X |
| 5,137,265 | 8/1992 | Sato et al. | 270/53 |

FOREIGN PATENT DOCUMENTS 0346851 12/1989 European Pat. Off. .

*Primary Examiner*—A. T. Grimley
*Assistant Examiner*—William J. Royer

[57] ABSTRACT

In a copier or printer producing a sequential stream of sheets with limited time therebetween, and with compiling and finishing of those output sheets on-line while subsequent sheets are being printed, a non-slip sheet feeder normally feeding copy sheets downstream to the compiler is selectably intermittently temporarily stopped holding the lead edge area of the first copy sheet for the next set to be finished so that continued feeding of the trail end of the same sheet by a relatively closely spaced upstream feeder buckles that sheet into a buckle chamber assisted by a buckle inducing arcuate baffle extending from the other side of the sheet path. The next printed sheet is fed normally while the buckled first sheet is positively held out of its way. When the second sheet reaches the downstream feeder, it restarts to positively feed both sheets downstream to the compiler, together, but overlapped by a preset amount for registration stacking. A substantial increase is provided in the time for the preceding copy sheets to be operated on in the compiler. A plural sheet collection point may also be provided by this sheet buffering system.

14 Claims, 7 Drawing Sheets

TRAIL EDGE BUCKLING SHEET BUFFERING SYSTEM

Cross-reference and citation is made to two copending applications addressing some of the same problems and technology by the same assignee: U.S. application Ser. No. 08/025,475, filed Mar. 3, 1993, by Barry P. Mandel, et al., entitled "Single Drive Nip Sheet Buffering System Using Independently Driven Rolls with Different Frictional Properties"; and U.S. application Ser. No. 08/057,941, filed May 7, 1993, by Richard S. Smith, entitled "Print Skip Avoidance For On-Line Compiling".

There is disclosed herein an improvement for electrostatographic or other reproducing machines sequentially printing sheets for job sets, and more particularly an improved, low cost and simple system for avoiding inter-set printing delays with on-line job set compiling and/or finishing, by a system for delaying selected sheet feeding to the compiler, yet maintaining positive feeding control over the sheets.

On-line set compiling and finishing is very desirable for the pre-collated sets of output copies printed and outputted sequentially by many modern high speed copiers and printers, for stacking and stapling or other finishing. However, the typical process of set collection of the printed output sheets (stacking with edge registration in a compiler tray or bin), and, especially, then stapling and ejecting that stapled set, takes a finite time period. The desired compiling and finishing time period for each collated set is often greater than the normal time period or pitch provided between the copy sheets, since the copy sheets are desirably being as rapidly sequentially printed and outputted by the copier or printer as possible. This has often necessitated a programmed "skipped pitch", or non-print cycle, in the print engine, for each set finished on-line, in many present reproduction systems. These non-print skipped pitches reduce overall productivity, especially for small job sets.

Maximizing time between incoming sheet job sets being compiled is critical to desirably providing increased available compiling and finishing time. That includes the various times required for any active edge registration feeding or jogging, active clinching, stapling, and set ejection from the compiler, and other such typical sequential functions in a compiler/stapler unit. If the finisher is an adhesive bookbinder or thermal edge binder tape type, even more finishing time may be required or desired than for normal stapling. Likewise, for a plural staple finisher, e.g., an edge stapler, or a center spline saddle stapler or stitcher, in which the set is stapled more than once with the same Stapler.

The buffer system disclosed in the exemplary embodiment hereinbelow enables a first sheet about to be delivered to an output to be held (delayed) and overlapped with a second sheet [and likewise with subsequent sheets, if desired], and then to have all the buffered sheets delivered together (while maintaining an appropriately selected overlap) to a downstream compiling or other output device, if desired. This may be accomplished by temporarily stopping a downstream feeding nip with the desired sheet in the nip and buckling the trail edge of that sheet out of the paper path by the continued downstream feeding of that sheet by an adjacent upstream feeding nip. The next sheet may then be fed up to this stalled downstream nip, at which time that stalled nip can be restarted, and both sheets fed by that nip, without slip. This enables improved overall productivity (the printer does not have to skip a print pitch each time the output device compiles and staples a prior set, for example) in a compact design, at very low cost.

Sheet buckling, per se, is, of course, known for other reproduction apparatus sheet feeding applications or functions, such as "Z-folders" (with delay). E.g., Cols. 21–22 of Canon Corp. EP No. 0 346 851 published Dec. 20, 1989. Copier paper web buckling is also known, e.g., Xerox Corp. U.S. Pat. No. 3,882,744.

Also noted by way of background re flat Mylar TM type paper path or document path flaps or blade springs that could be added here at one side of the sheet path for helping to deflect the trail edge of the first sheet towards the buckle chamber side of the sheet path and help keep it out of the way of the next sheet are, e.g., Ricoh, U.S. Pat. No. 5,083,761; Canon, U.S. Pat. No. 4,627,709, e.g., FIGS. 2A, 8A or 13A; and Xerox Corp. U.S. Pat. No. 4,849,788.

An optional additional or alternative feature or utility of the copy sheet buffering system disclosed hereinbelow is to serve as a "cluster jam" recovery sheet collection point in a reproduction apparatus. By way of background, cluster jam systems art includes Xerox Corporation pending U.S. application Ser. No. 07/045,288, filed Apr. 12, 1993, by Elizabeth Fox, entitled "Hierarchy of Jam Clearance Options Including Single Zone Clearance" and art cited therein. That art includes Xerox Corporation U.S. Pat. Nos. 4,231,567 to R. T. Ziehm; 4,786,041 to T. Acquaviva, et al; 4,627,711 to S. M. Schron; and Eastman Kodak Co. U.S. Pat. No. 5,058,879. As particularly explained in said U.S. Pat. No. 4,231,567, when a jam occurs in a reproduction apparatus, unless a total immediate machine "hard stop" is required, it is desirable to feed the several upstream unjammed sheets downstream in the normal sheet feed path to be "clustered" or stopped together at a convenient sheet stopping and removal point along the sheet path upstream of the jam point, for convenient subsequent operator sheet removal. That is, if those sheets cannot be fed onto an output tray because a detected jam area is downstream between that "cluster" stopping point and the output tray. Thus, jam clearance of a machine after a jam is simplified, since sheets do not have to be individually removed along the entire sheet feed path (paper path) of the machine. Said U.S. Pat. No. 4,231,567 to R. T. Ziehm also discloses duplex path buffering with sheet shingling, as does the Canon NP-4835 copier duplex tray.

Among the potential features, advantages and applications of the exemplary sheet buffering system of the embodiment hereinbelow (in comparison to various cited prior art and cross-referenced commonly owned copending applications) are the following:

(a) This disclosed system can be more reliable, since it does not depend on or employ feeding nip slip, and is not dependent on a nip maintaining two different coefficients of friction, or on slippage between sheets in a feeding nip.

(b) The sheet handling size range can be much greater, and even undersize (small) sheets can be handled, since the upstream and downstream feeding nips can be much more closely spaced, preferably by less than the smallest normal sheet dimension in the feeding direction. Also, no prelocated step or baffle transition is required in the sheet path critically located relative to a sheet dimension.

(c) Less hardware and control is required. The only addition to a conventional or normal sheet path in the example below is a clutch [or independent electric motor] for intermittently stopping or stalling one otherwise normal non-slip downstream sheet feeding nip, and simple sheet path baffle changes to induce and allow sheet buckling out of the normal sheet path when that nip is stopped.

(d) This disclosed buffer system is less jam prone, especially for curled copy sheets (a major problem, especially in color printers after copy sheet drying and/or fusing). A major portion of the sheets being buffered are positively driven substantially out of the normal sheet path so as to not interfere with or frictionally resist the feeding in of subsequent sheets to be buffered. In particular, the trailing edges of all buffered sheets are drivert out of the normal sheet path for the subsequent sheets feeding, and their trail ends positively held out of that normal sheet path by the upstream feed rollers overlying baffle. Thus, even if the trail edges of the buffered sheets are curled towards the sheet path, they normally cannot get back into the sheet path to stub or jam the lead edge of further sheets being fed downstream, in this disclosed buffer system.

(e) controlled accurate relative incrementing (overlapping or shingling) of the buffered sheets can be provided simply by correspondingly incrementing the non-slip downstream nip. As disclosed, this can be easily redefined for the amount of desired lead or trail edge lag desired between sheets.

(f) The desired shingling order can be changed without increased cost or complexity simply by changing from upward to downward buckling, simply by reversing the baffles, if desired.

(g) The disclosed system can be utilized as a desirable "cluster jam point", as further explained herein and in the above-cited art thereon, wherein several upstream sheets can be fed to that point and accumulated there in a single buffer site for convenient post jam sheet clearance removal.

(h) The disclosed system could alternatively or additionally be used in an endless loop duplex path to provide shingling of several sheets printed on one side being returned for second side printing and thus increase the duplex path sheet capacity without increasing the duplex path length. [Shingled sheet duplex paths are known, per se, from the above-cited U.S. Pat. No. 4,231,567 and the duplex tray of the Canon Corporation NP-4835 copier product.]

(i) Typically, there is provided in a set compiler unit a driven frictional flapper, belt, or other such sheet jogger for active positive registration, acting on the top sheet of the stacks of sheets being compiled in the compiler tray. That presents additional problems if the subsequent sheet extends into the compiler too far before the preceding set can be removed and is accidentally attempted to be acquired by this active registration device. E.g., the sheet could be smeared or marked. The present system avoids this problem, since only a small portion of the lead edge area of the delayed sheet need extend out of the exit rolls nip until it is to be fully ejected.

One prior partial solution to the problem of print delays for compiling has been to use a higher speed final or exit transport in the downstream sheet output path, higher than the sheet path velocity of the printer/processor, so as to increase the spacing between sheets as they are fed into the compiler. However, such very high speed ejection of the sheets creates problems of its own, such as will sheet stopping impact edge damage, "airplaneing" of the sheets interfering with compiler stacking, etc., Alternatively, the first sheet of the next set can be briefly temporarily slowed down or stopped by a time period less than the intersheet pitch or gap between it and the next sheet. However, that time period is quite limited.

Another solution to that problem has been to use plural paper paths and/or plural compilers so as to divert and delay the arrival of the first sheet of a subsequent set to another path while stapling and ejecting the previous set. Plural compilers are used, for example, in the Xerox Corporation "DocuTech" printer and "5090" duplicator, as described for example in Xerox Corporation U.S. Pat. No. 4,782,363, issued Nov. 1, 1988 to James E. Britt, et al. Another patent with dual (selectably gated) sheet output paths is disclosed in U.S. Pat. No. 5,083,769, issued Jan. 28, 1992 to John J. Young, Jr. (Pitney-Bowes, Inc.). Another such dual path system is described in Canon Corp. patents cited below such as U.S. Pat. No. 5,137,265, and EP No. 0 346 851, where two sheets are fed through different length paths and then overlapped and commonly ejected. However, such dual paths significantly complicate the paper paths, and their drive components require additional space and cost, and have more complicated jam clearances and/or sheetpath access for jam clearance.

Another reported commercial prefinishing delay system, by Eastman Kodak Co., in its EKTAPRIN 300 and possibly other copier products is schematically represented in FIG. 8, here, labeled "prior art." As understood, it uses a large elastomeric cylindrical feed roller, and a hemi-cylindrical surrounding baffle, upstream of a sheet output gate. At least two sheets are overlapped while the first sheet is temporarily held by this gate, and then the two sheets are commonly ejected. However, in that system, there is reportedly an undesirable requirement to slide the second sheet under the first for a long distance within the confined arcuate baffle while the first is held stationary in the same thin arcuate space. Also, as understood, there is no positive drive of the first (outside) sheet during the initial feeding out of both sheets to the compiler. This runs contrary to a basic tenant of sheet handling to maintain all sheets in a positive feeding nip at all times, rather than depend on low friction between sheets to slide past one another, or high friction between sheets to overcome baffle friction and other resistances, especially with arcuate sheet paths, and especially where pushing, rather than pulling, a flimsy sheet.

Another patent noted was Océ Nederland B.V. U.S. Pat. No. 5,012,296, issued Apr. 30, 1991 to Jay Dinnissen, et al. This patent shows an inverter in the duplex path and also in the document handler path.

Pending commonly assigned Xerox Corporation application Ser. No. 07/907,273, filed Jul. 1, 1992 by Thomas Acquaviva entitled "Document Handling System Having a Shunt Path" provides a long and "U" shaped shunt loop path, and for a different function; for original documents to be held in that path for copying a set of documents out of order.

Another type of system may exist in which all the output copy sheets are slowed down before their output in a shingling device or system which runs at a slower speed than the printer processing speed so as to cause the copy sheets to partially overlap or shingle upon one another. However, this then would appear to require a more complex and difficult arrangement to separate, compile and stack the completed job sets, and make it even more difficult to obtain a sufficiently clear space in distance and time between the last sheet of one set to be compiled, stapled and ejected and the next sheet of the next set to be compiled.

Prior art copier or printer output sheet inverters are also variously shown in the above and various other patents. These normally operate by feeding one end of a sheet into an inverter chute from one (upstream) sheet path direction and feeding the other end of the sheet out of the inverter in the other (downstream) path direction, so as to turn the sheet over, end for end.

Prior art on cover or other sheet inserters is distinguishable, as not presenting these same problems. There the insert sheets are already preprinted and are coming from a separate supply of these extra sheets, and are merely being merged with the printer or copier output sheets. Thus, these extra inserted sheets do not require any interference with or delay in the continuity of the printing process.

A specific feature of the specific embodiments disclosed herein is for a reproduction apparatus feeding a sequential stream of printed copy sheets into a normal sheet path with a limited space and time therebetween, a sheet buffering system comprising: a non-slip downstream sheetfeeding nip normally feeding copy sheets downstream towards a sheet output in said normal sheet path; said downstream sheet feeding nip being selectably intermittently temporarily stopped with a lead edge of a first copy sheet therein; a sheet buckle chamber upstream of said downstream sheetfeeding nip extending away from said normal sheet path; a non-slip upstream sheet feeding nip positioned sufficiently closely to said downstream nip along said normal sheet path to simultaneously feed said first sheet in said upstream nip while a lead edge of the same sheet is in said downstream nip to drive the trail end of said first copy sheet into said buckle chamber when said downstream nip is so temporarily stopped, and to then feed a second copy sheet with said upstream nip in said normal sheet path past said first copy sheet in said buckle chamber to said downstream nip; buckle-inducing sheet baffling in said normal sheet path between said upstream and downstream feeding nips; and said downstream nip then being automatically restarted upon said feeding of said second copy sheet thereto by said upstream nip to feed said first copy sheet from said buckle chamber in coordination with the feeding of said second copy sheet, so that both said first and second copy sheets are fed downstream by said downstream nip.

Further specific features disclosed by the system disclosed herein, individually or in combination, include those wherein said normal sheet path is a sheet output path of said reproduction apparatus, and said reproduction apparatus is provided with a compiler/finisher fed by said output path and said downstream nip for repeatedly sequentially stacking said copy sheets in said compiler/finisher for compiling with edge registration and finishing of said stream of output sheets into plural collated finished sets on-line as subsequent said copy sheets are being printed and outputted by said sheet output path of said reproduction apparatus; and/or wherein said downstream feeding nip is intermittently temporarily stopped and restarted in coordination with the operation of said compiler/finisher on preceding copy sheets, and wherein said downstream sheet feeding nip is restarted to feed both said first and second sheets together downstream to said compiler tray with a substantial increase in the time between the feeding out of said first copy sheet by said downstream sheet feeding nip and preceding copy sheets so fed in said compiler/finisher; and/or wherein said normal sheet path is substantially planar and the trailing end of said first sheet is maintained substantially out of said planar normal sheet output path in said buckle chamber as a subsequent sheet is fed downstream in said normal sheet path by said upstream nip, and/or wherein said first sheet is lapping said second sheet as they are so fed to said compiler/finisher by said downstream sheet feeding nip, by leading said second sheet at the edges of said first and second sheets which are being edge registered in said compiler/finisher, and/or wherein said first sheet is overlying said second sheet as they are fed out by said downstream sheet feeding nip, with the leading edge of the overlying said first sheet extending out ahead of the underlying said second sheet, and/or wherein the normal printing order of said first and second sheets is reversed, and/or wherein said sheet buckle chamber extends above said normal sheet path, and/or wherein said sheets are fed by said downstream sheet feeding nip to a compiler tray with edge registration with said first sheet slightly shingled relative to said second sheet for edge registration in said compiler tray, and/or wherein the trailing edge of said second sheet fed into said compiler tray by said downstream nip for uphill compiling is underlying said first sheet and following the trailing edge of said first sheet, and/or wherein said sheet buffering system providing a cluster jam recovery point for collecting plural said copy sheets from upstream thereof in said buckle chamber in response to a detected downstream jam in the copy sheet path, and/or wherein said upstream nip comprises a rotating upstream sheet feeder, and wherein the trail edges of buckled copy sheets are stripped off of said upstream sheet feeder by a mating baffle, which mating baffle then holds said trail edge away from said upstream sheet feeding nip.

The present invention is applicable to almost any on-line compiler/finisher system, not limited to those illustrated. By way of further background, some examples of compiler trays with joggers or other set registration systems and staplers or stitchers (generally referred to herein as staplers), include Xerox Corporation U.S. Pat. Nos. 4,417,801 and 4,541,626. The compiler unit herein could alternatively be, for example, similar to that disclosed and described in allowable Xerox Corporation application Ser. No. 07/888,091, filed May 26, 1992, by Barry P. Mandel, et al., or that of his issued U.S. Pat. No. 5,098,074. Other examples of compiler tray registration sheet feeder/joggers are in (and cited in) Xerox Corporation U.S. Pat. No. 5,120,047. As noted there, and as otherwise well known, the compiler tray may be one of a plural array of compiler trays or bins.

It will also be appreciated that compilers and finishers may be internal or external, such as in modular units operatively connecting with the reproduction apparatus, as disclosed in the above and other patents and products.

The terms "copy sheet", "copy", "output", or "output sheets" herein are still generally used to refer to the paper or other such typical flimsy physical image substrate sheets outputted by a reproduction apparatus, such as a xerographic copier or printer, and whether imaged or printed on one or both sides. These output sheets are now often, of course, not literal "copies" in the old-fashioned sense, since the term now may also encompass computer generated graphic images (as well as various text) for which there is not necessarily a physical "original" being copied optically or electronically scanned, although that is also encompassed by the term "copy" or "output" sheets here. Likewise, the term "printing" here does not imply old-fashioned uncollated letterpress printing. A "job" is a set of related sheets, usually a collated copy set copied from a set of original document sheets or electronic page images from a particular user or otherwise related.

This system will work with N-1 or 1-N output page sequence printers or copiers, and/or faceup or facedown output for compiling, or any of these possible combinations. For "1 to N" output the two sheets acted on by this system would be sheets 1 and 2 of the next collated set. For "N to 1" output, the two sheets to be acted on for delay would be sheets N and N minus 1 of the next collated set. The "first" and "second" sheets discussed herein can be either. The shingling of these two sheets will not affect proper registration in any of those modes, if adjusted as discussed above.

The disclosed apparatus may be readily operated and controlled in a conventional manner with conventional control systems. Some additional examples of various prior art copiers with control systems therefor, including sheet detecting switches, sensors, etc., are disclosed in U.S. Pat. Nos.: 4,054,380; 4,062,061; 4,076,408; 4,078,787; 4,099,860; 4,125,325; 4,132,401; 4,144,550; 4,158,500; 4,176,945; 4,179,215; 4,229,101; 4,278,344; 4,284,270, and 4,475,156. It is well known in general and preferable to program and execute such control functions and logic with conventional software instructions for conventional microprocessors. This is taught by the above and other patents and various commercial copiers. Such software may of course vary depending on the particular function and the particular software system and the particular microprocessor or microcomputer system being utilized, but will be available to or readily programmable by those skilled in the applicable arts without undue experimentation from either verbal functional descriptions, such as those provided herein, or prior knowledge of those functions which are conventional, together with general knowledge in the software and computer arts. Controls may alternatively be provided utilizing various other known or suitable hardwired logic or switching systems. As shown in the above-cited and other art, the control of exemplary sheet handling systems may be accomplished by conventionally actuating them by signals from the copier or printer controller directly or indirectly in response to simple programmed commands and from selected actuation or non-actuation of conventional copier switch inputs by the copier operator and sheet position sensors in the sheet paths. Conventional sheet path sensors and/or switches, connected to the controller may be utilized for sensing and timing the positions of the sheets, as is well known in the ar-t, and taught in the above and other patents and products. The resultant controller signals may conventionally actuate various conventional electrical solenoid or cam-controlled sheet deflector fingers, motors or clutches in the selected steps or sequences, as programmed. [The Federal Circuit has held that if a microprocessor is indicated in the specification, one skilled in the art would know how to perform the necessary steps or desired functions described in the specification, and need not necessary disclose actual software or "firmware" for 35 USC §112 disclosure support. In re *Hayes Microcomputer Products Inc. Patent Litigation* (CA FC 12/23/92).]

As to specific hardware components of the subject apparatus, or alternatives therefor, it will be appreciated that, as is normally the case, some such specific hardware components are known per se in other apparatus or applications which may be additionally or alternatively used herein, including those from art cited herein. All references cited in this specification, and their references, are incorporated by reference herein where appropriate for appropriate teachings of additional or alternative details, features, and/or technical background.

Various of the above-mentioned and further features and advantages will be apparent from the specific apparatus and its operation described in the examples below, as well as the claims. Thus, the present invention will be better understood from this description of these embodiments thereof, including the drawing figures (approximately to scale) wherein:

Figure 6:
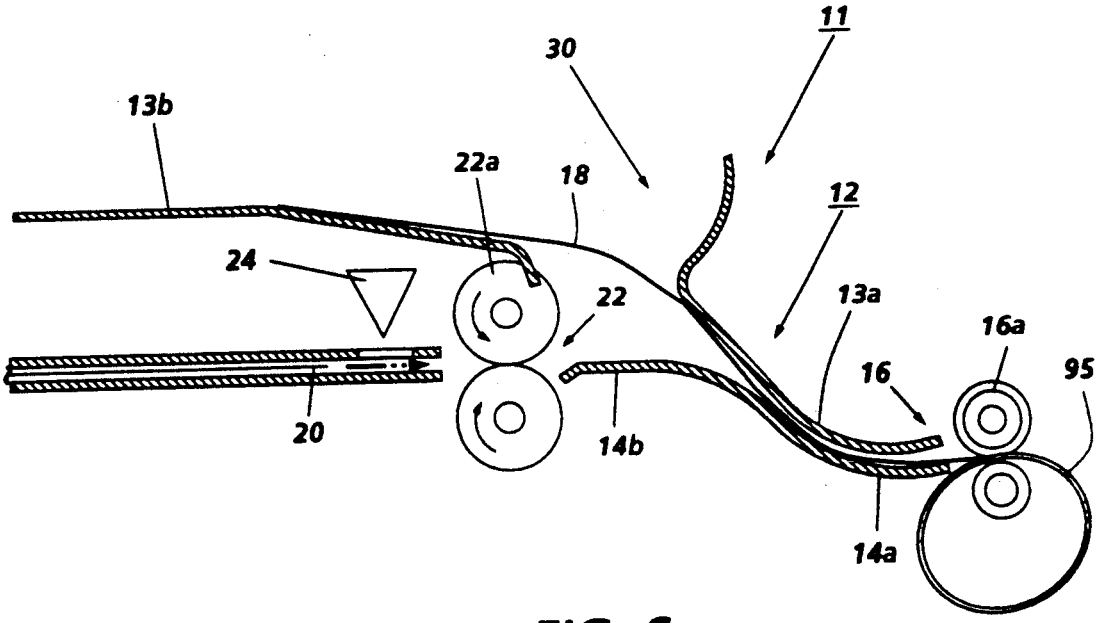
Figure 7:
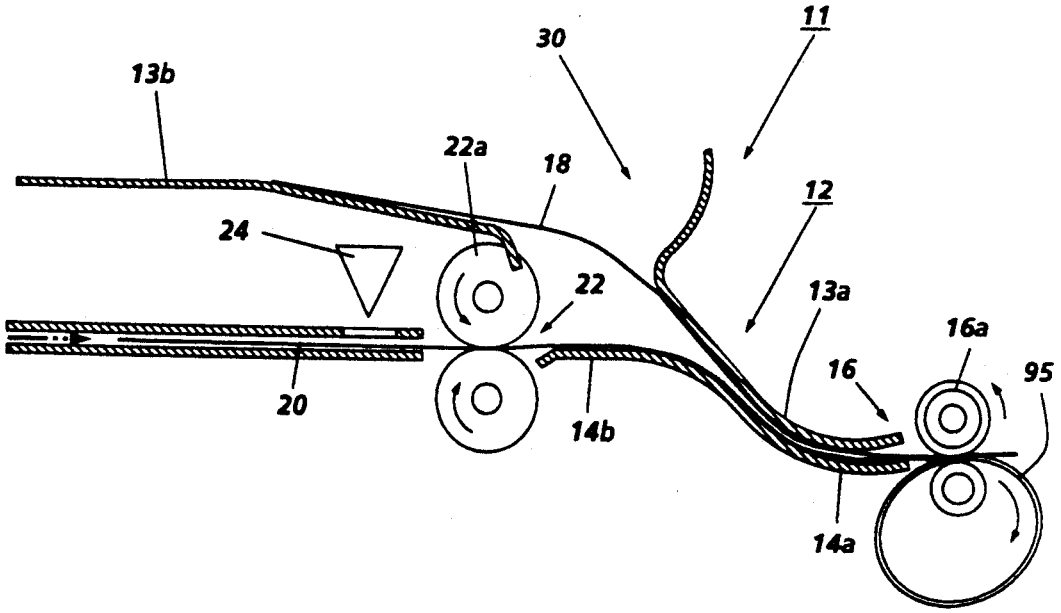
Figure 8:
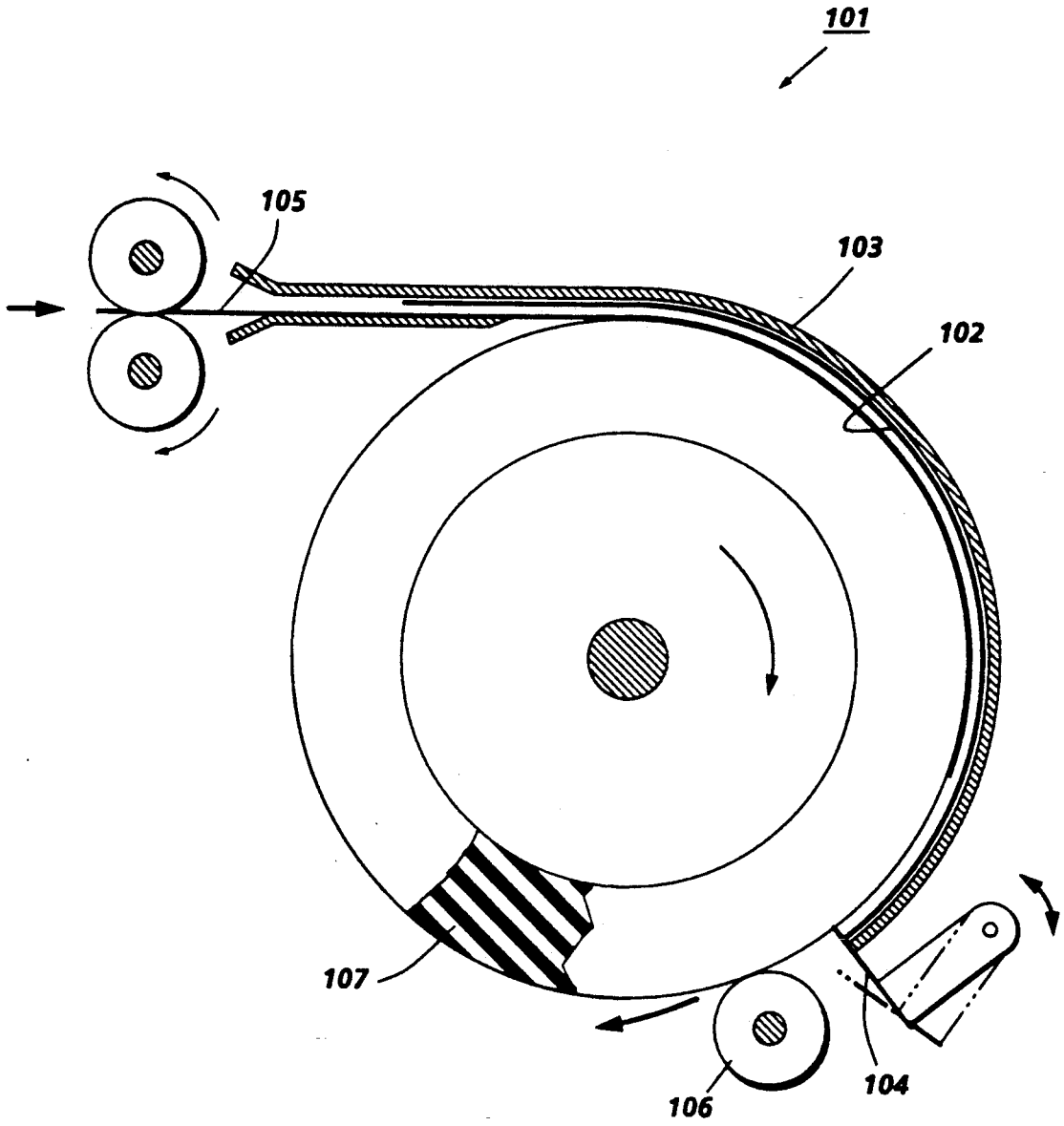
PRIOR ART FIG. 8

FIG. 8, labeled "prior art", illustrates an understanding of a prior art Eastman Kodak Co. product system, discussed above and below; and FIGS. 9-11 show three alternative upstream feeder modifications of the buffer system of FIGS. 3-7.

The sheet buffering system disclosed in these illustrated exemplary embodiments can overcome the above and other compiler printing delay problems in an otherwise desirably normal sheet output system by delaying the first (single) sheet following the last sheet of the previous job set to be compiled. This is done in these examples by stopping a downstream paper path nip for that sheet, with that sheet in the nip, but continuing the feeding of that same sheet by an upstream nip simultaneously engaging that sheet, to buckle the sheet into an intervening buckling system buckling the sheet off from the normal or main output path. Meanwhile, the subsequent, immediately following, (second) sheet is feeding out normally, passing this buckled sheet and going to the stalled downstream nip, which now restarts feeding forward (downstream) so that the first sheet is now shingled over (or under) the second sheet, and both overlapping sheets are now driven forward, but with one sheet lagging slightly behind the other in the output path. Both sheets may thus be fed into the (now emptied) compiler tray by the normal operation of the output feeder to start the next set to be compiled and finished. Meanwhile, this operation has provided a substantial increase in the distance and time between these two sheets and the immediately prior last sheet of the previous compiled set. As further noted, this same basic buffering system can also be alternatively used to provide other buffering systems such as for duplexing or cluster jam systems, for several sheets, and is not limited to use with on-line compiling/finishing systems, although particularly suitable therefor.

To express that another way, disclosed herein is a simple, low cost modification or output path addition to almost any conventional copier or printer producing a sequential stream of sheets with limited time therebetween, and with compiling and finishing of those output sheets on-line while subsequent sheets are being printed, a non-slip sheet feeder normally feeding copy sheets downstream to the compiler is selectably intermittently temporarily stopped holding the lead edge area of the first copy sheet for the next set to be finished so that continued feeding of the trail end of the same sheet by a relatively closely spaced upstream feeder buckles that sheet into a buckle chamber assisted by a buckle inducing arcuate baffle extending from the other side of the sheet path. The next printed sheet is fed normally while the buckled first sheet is positively held out of its way. When the second sheet reaches the downstream feeder, it restarts to positively feed both sheets downstream to the compiler, together, but overlapped by a preset amount for registration stacking. A substantial increase is provided in-the time for the preceding copy sheets to be operated on in the compiler.

Figure 1:
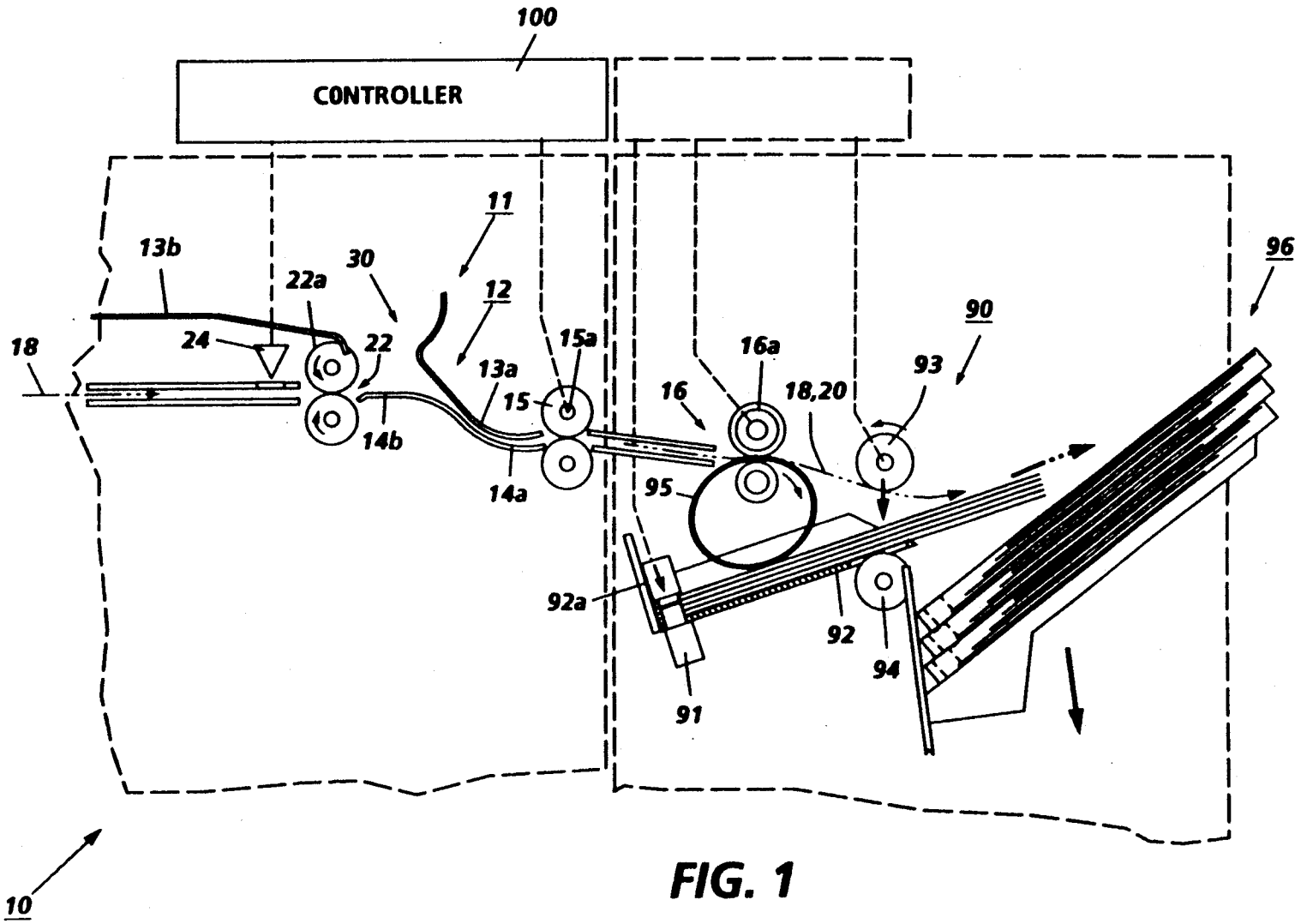
FIG. 1 is a schematic side view of one embodiment of the subject sheet buffering system shown in one example providing printer delay avoidance for compiling and finishing, shown with one operatively connecting exemplary compiler/finisher unit.

There are some differences between the buffer system 11 of FIG. 1 vs. FIGS. 3–7, and 9–11. However, since the operation is basically the same, they will be generally described as buffer system 11 herein, with explanations of the differences. Primarily, in FIG. 1, "downstream nip" is output nip 15, stalled by clutch 15*a*, whereas in the other Figures, the "downstream nip" is 16, the compiler entrance nip stalled by clutch/brake 16*a*. Either is suitable. Where "16" is referred to below, it is intended to also apply to "15" as well, unless indicated otherwise. An advantage of the system shown in FIG. 1 is that the flexible registration assistance belt 95 nip (nip 16) can be left running continuously during the buffering operation, yielding more time to compile sheets.

The buffer system 11 for a printer 10 here all of these examples has a main sheet output path 12 defined by a downstream upper baffle 13*a*, an upstream upper baffle 13*b*, a downstream lower baffle 14*a*, an upstream lower (buckling) battle 14*b*, a downstream feed nip 16 (or 15) at the downstream end, and an upstream feed nip 22 at the upstream end. There is less than one sheet dimension between these two feed nips 16 and 22. A buckle chamber 30 starts just downstream of nip 22, and is shown between upper baffle 13*b* and 13*a* in this example. Alternatively, the buckle chamber 30 can be below the main path 12, as discussed herein. The buckle chamber 30 provides a substantially opening away from the main sheet path 12 for a sheet buckle to form therein.

The operation of this exemplary buffering system is further successively sequentially illustrated in FIGS. 3 to 7. For purposes of discussion here, a "first" sheet 18 and "second" sheet 20 will be referenced. The "first" sheet 18 is the sheet to be buffered. For print delay avoidance, sheet 18 is the sheet immediately following the immediately prior "last" sheet of the previously collated job set in compiler 90 tray 92. The "second" sheet is the sheet not being buffered immediately following the "first" sheet (or sheets). The sheets here are being printed and fed out in a normal, evenly spaced, sequence. The operation for the "first" sheet 18 described herein can be repeated for as many subsequent sheets as are desired to be buffered.

The exemplary system here uses stalled feed rolls (known, per se, for other functions) to stall downstream nip 16, to stall the first sheet 18 and move its trail edge out of the paper path into buckle chamber 30. This allows the second sheet 20 to feed in past the first sheet 18 in the main sheet path 12 defined by the baffles without sheet stubbing. A sheet lead or trail edge switch or sensor 24 also detects the position of the second sheet 20 and restarts the stalled nip 16 feed rolls at the appropriate time to ensure a correct amount of sheet overlap [e.g., about 20 mm]. The sheets are then fed together through the previously stalled nip 16, maintaining the overlap or shingling, and out to the compiling station (90 or 80). The downstream nip 16 may be driven using a separately controlled motor, or it may be driven off the existing main drives and stopped using a clutch/-brake 16*a* as shown schematically here.

Figure 3:
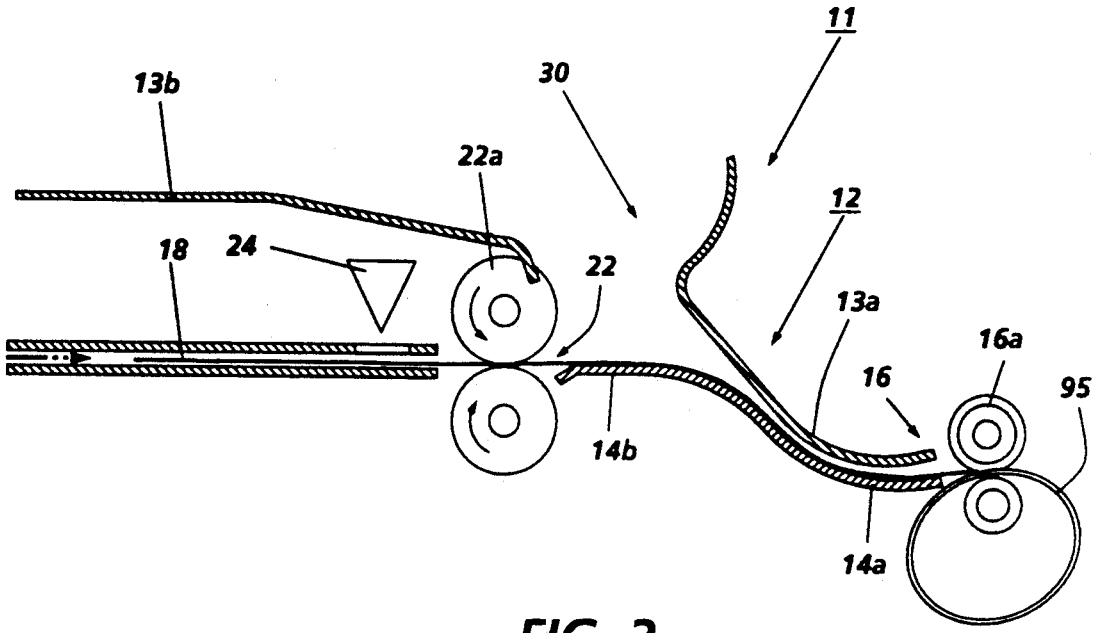
FIGS. 3-7 are identical side views of the key portions of a different embodiment from the sheet buffering system of FIG. 1, respectively showing sequential operating steps thereof.
Figure 4:
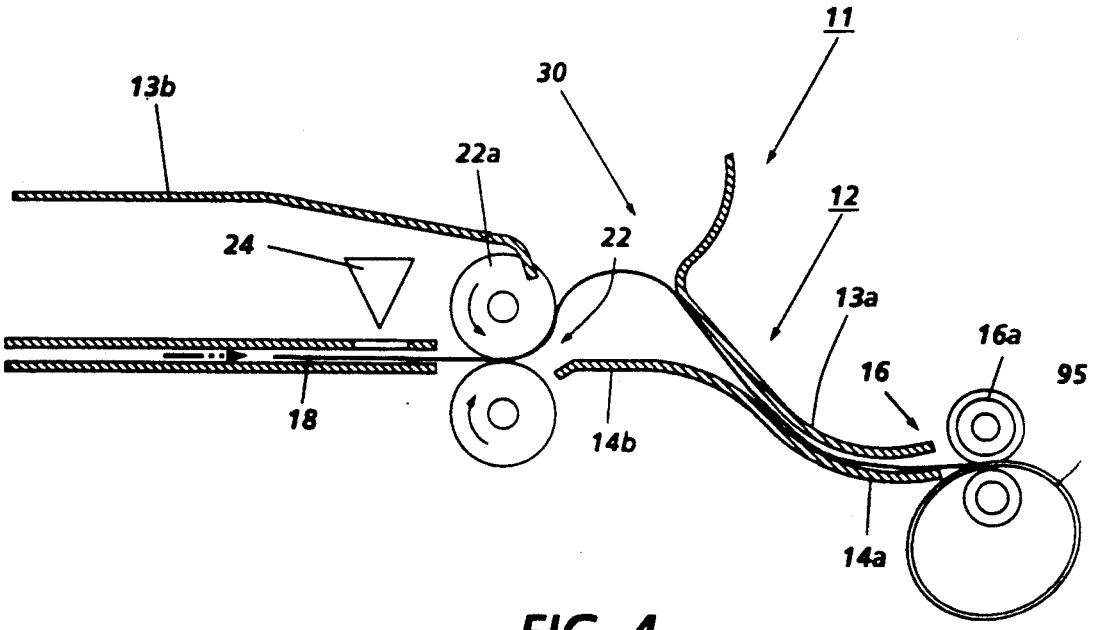
Figure 5:
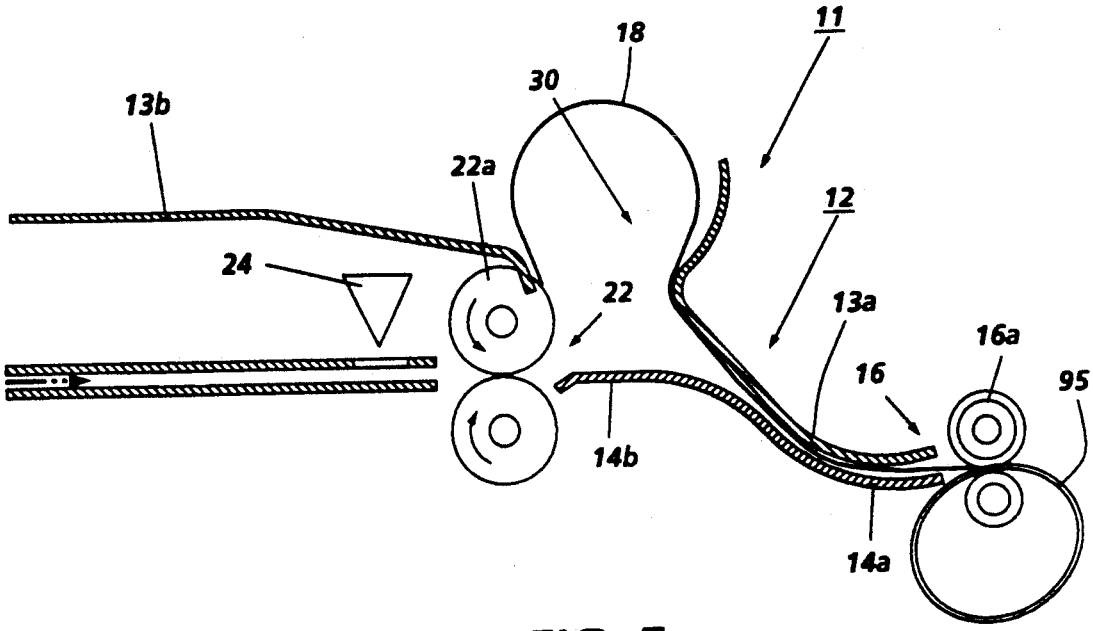

As further particularly shown, starting in FIG. 3, the first sheet 18 is fed into and slightly through the downstream nip 16 by a pre-defined distance, e.g., about 20 mm. [This distance controls the eventual sheet overlap that will result from the buffering operation.]The sheet 18 is positively held in and by both the nips 16 and 22 at that point. The downstream nip 16 is then stopped, but not in nip 22, and the sheet 18 begins to buckle, as shown in FIG. 4, with sheet buckling in the desired direction being induced by the opposing convex lower (buckling) baffle 14*b*. The sheet 18 continues to feed from the upstream nip 22 and buckle into the buckle chamber 30, as shown in FIG. 5. The buckled sheet 18 trailing end now springs up out of the upstream nip 22 as it feeds out of that nip 22, as in FIG. 5, and when it does it lies on top of the upstream upper baffle 13*b*, as shown in FIG. 6. The trail edge of the first sheet 18 is thus now positively held out of the main paper path on baffle 13*b*. The second sheet 20 is meanwhile now fed in by nip 22. The second sheet 20 can feed in normally down normal sheet path 12. It can be easily and reliably fed past the now buckled-away first sheet 18, as shown in FIG. 7.

When, or slightly before, the lead edge of this second sheet 20 reaches the downstream (stopped) nip 16, as in FIG. 7 (as predicted from sensor 24), the nip 16 is restarted and both sheets may then be fed out together by nip 16 positioned relative to each other with the correct amount of desired overlap. [Optionally, the second sheet 20 lead edge could be slightly buckled into the stalled downstream nip 16 before nip 16 restarts, to minimize tolerance on the sheet overlap amount or distance.]in FIG. 7, both sheets 18 and 20 have reached, and are ready to be fed together forward, by the rollers forming nip 16. The two sheets are overlapping, with the lead edge of underlying sheet 20 slightly behind the lead edge of overlying sheet 18, in this example.

This procedure of (1) controlling the distance that the first sheet is driven into the nip, and (2) slightly buckling the second sheet as it is driven into the stalled nip (to ensure the location of it's lead edge is well controlled), and then (3) restarting the stalled nip to drive both sheets out, can also accurately control the intersheet shingling distance, without the need to accurately control the acceleration of the nip 16 as the nip 16 velocity is ramped up after being stalled. [In contrast, precise velocity and acceleration control is needed with dual path and reversing roll buffering systems.]

Figure 9:
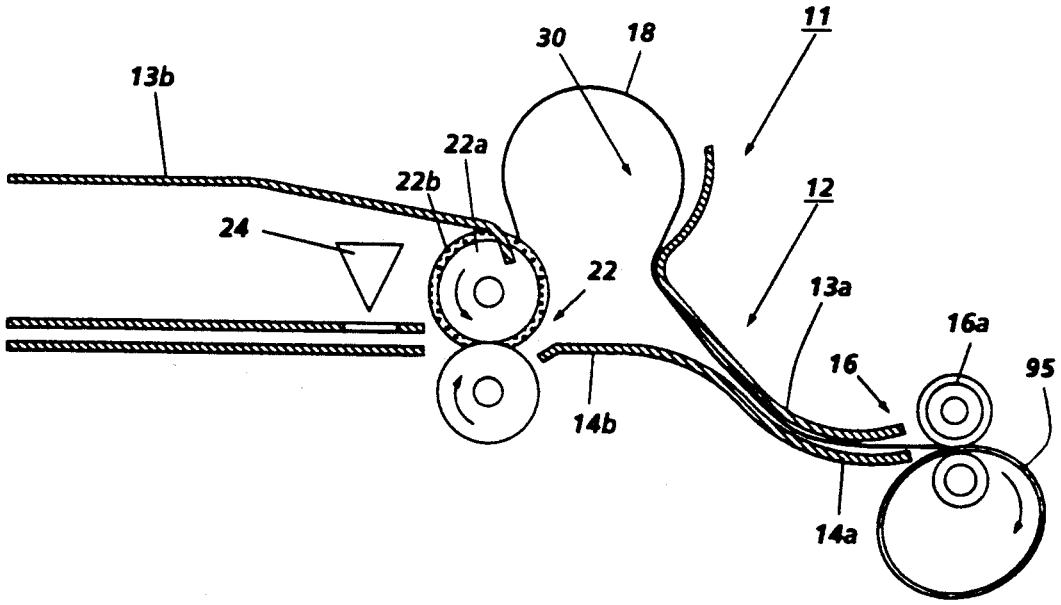
Figure 10:
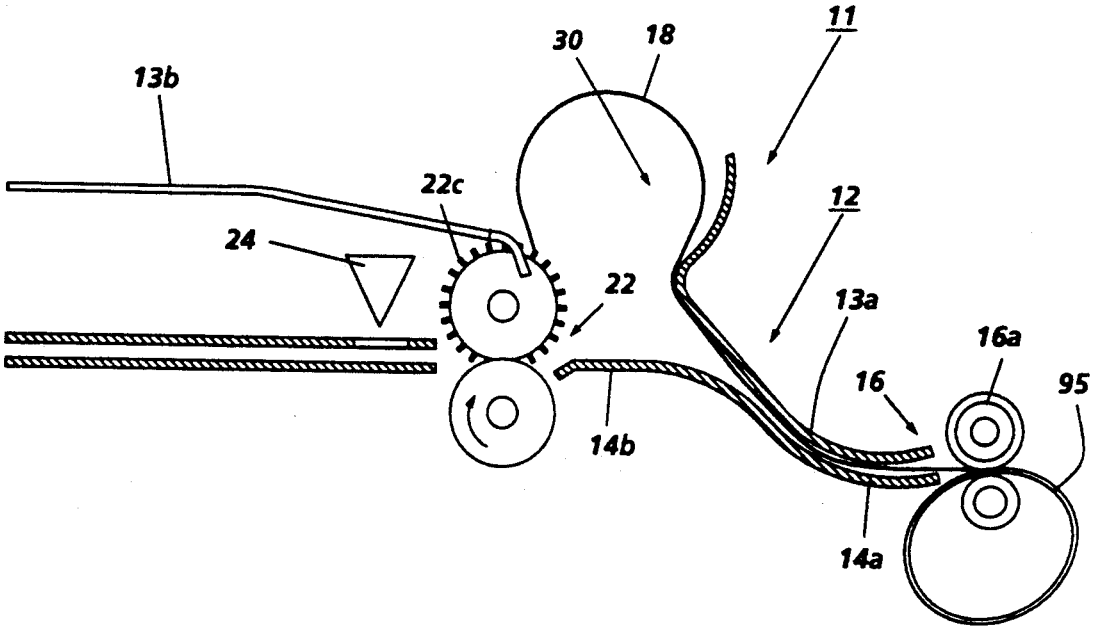
Figure 11:
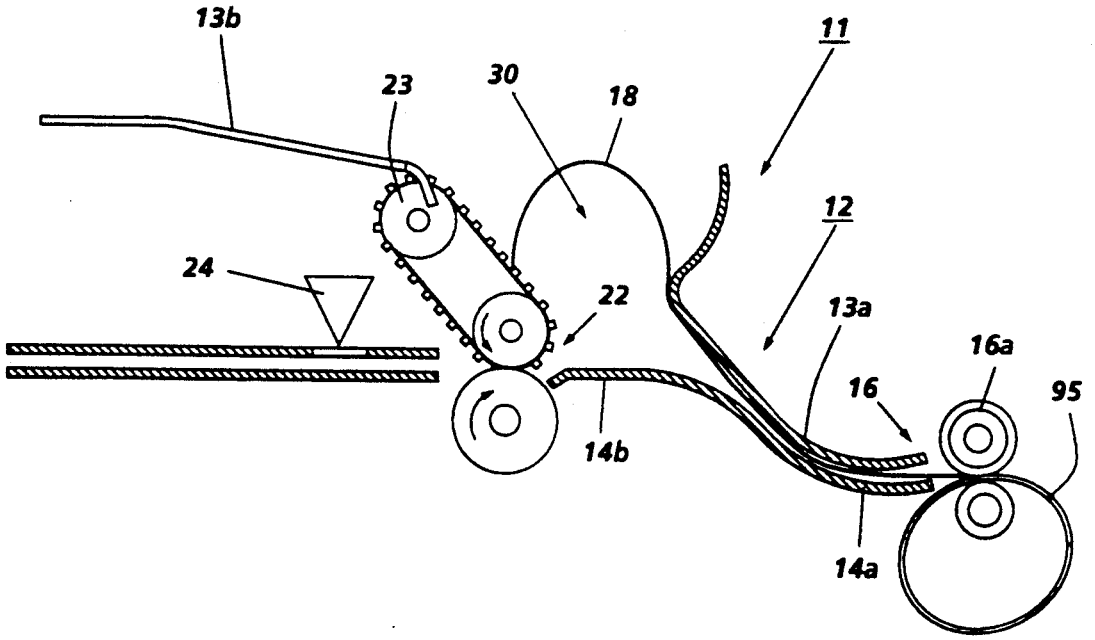

As shown in the examples of FIGS. 9, 10 and 11, several feeder alternatives can be used for the upstream drive nip 22 to even better ensure that the trail edge of the first sheet 18 is so buckled positively and correctly. Although conventional feed nips 22 with rollers 22a may be used, as shown, various configuration variations for the upper roll of the upstream feed nip 22 are possible to assist buckling. in FIG. 9, foam rolls 22b are inter-positioned between the upstream nip 22 normal elastomer upper drive rolls 22a. The foam rolls 22b have a slightly larger diameter than the regular drive rolls 22a (but nip with normal diameter lower idlers) and therefore tend to "catch" the trail edge of the sheet and ensure that it is driven around the normal rolls 22a completely, and lifted up to lie on overlapping baffle 13b, as shown there. In the alternative of FIG. 10, small paddle-blades on rolls 22c (toothed rolls) are positioned between the normal upper drive rolls 22a. These elastomer paddles or fingers have a slightly larger outer diameter than the upper drive rolls 22a and therefore "catch" the trail edge of the sheet as shown to ensure it is driven around the rolls 22c to baffle 13b. In the alternative of FIG. 11, a small toothed belt 23 is used to provide a continuous driving surface and ensure that the tail edge of the sheet is driven into its buffer position correctly, especially for longer sheets, by holding and controlling the release of the trail edge into the buckle chamber 30 longer. In all cases, by the upper upstream feed rolls of nip 22 rotating in notches or slots in baffle 13b, the sheet is positively stripped off onto baffle 13b.

It should be noted that this system may be designed to readily change to buckle the sheets to either the top side or the bottom side of the paper path. This may be provided simply by a mirror image reversal of the positions of the upper and lower baffles, and thus, need not be separately illustrated here. The print sequence may, however, change depending on which of the two is selected. For example, if the first sheet is buckled to the bottom side of the paper path, the sheets may be overlapped as described and fed out in normal page order. I.e., pages 1,2,3, . . . etc. for a 1-to-N machine (with forward serial page order).

If, instead, the first sheet is buckled to the top side of the paper path, as shown, the first two sheets may be fed out in reverse order (i.e., pages 2,1,3,4,5 . . . etc. for a 1-to-N machine). This sheet buffering with reordering of the first 2 pages can be easily done on a digital copier or printer with no adverse affects on productivity or first-copy-out-time (FCOT). Note that there is no need to ever buffer any sheets for the first set out (since there is no previous set being stapled to wait for). Thus, after the complete job set has been electronically sent to the printer for printing or scanned in from a document set, the first set can be printed and fed in normal page order. I.e., 1,2,3,4, . . . etc.. The subsequent sets can be printed in said 2,1,3,4,5, etc. page order simply by electronically switching the printing order of the first two pages, which is easily done in a digital printer or copier.

In this example of an on-line print stream intermittent sheet delay buffer system 11, compiling and stapling of prior copy sheet sets from a printer or copier 10 may be done without interrupting or delaying any subsequent copy sheet printing. Only the final sheet output path 12 (comprising the subject system 11) and associated components need be shown here, since other components can all be conventional and unmodified. This special processing need be done here only for the first two sheets of the next set to be compiled, and only the first sheet need be handled abnormally in this system for that function.

Figure 2:
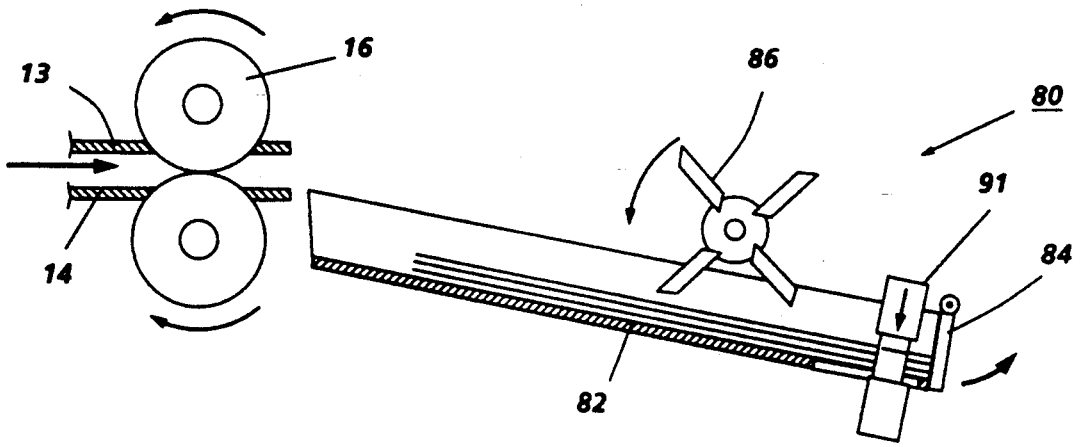
FIG. 2 is a partial side view showing a different (alternative) compiler unit embodiment, per se, with "downhill" stacking rather than "uphill" stacking, otherwise operative with all the other elements of any other figure here with the distinctions taught herein.

As noted above, this generally planar sheet output path 12 may have as in FIG. 1 or FIG. 2, its downstream nip 15 at exit feed rolls at the downstream end, just prior to the compiler/stapler module or unit 90, or, as shown in the FIGS. 3–7 and 9–11 examples illustrated herein, the downstream nip 16 is the entrance feed rollers in the compiler unit 90. Although exit rollers are shown, it will be appreciated that a feed belt or other sheet feeder could be utilized. The distance in the sheet path 12 between the upstream and downstream feed rollers nips 22 and 16 or 15 here is approximately slightly less than the feeding dimension of the smallest conventional feeding sheet, e.g., less than 20 cm in an edgewise or long-edge-first print system. The amount of this nip spacing depends on the amount of positive buckling desired and the smallest sheet dimension to be buckled. But, in any case, there is no compromise with normal feeding.

An existing controller 100 of the printer or copier reproduction apparatus 10 may control all the operating steps indicated herein, as discussed above, and is conventionally connected to the sensor 24, and other conventional sheet edge detection sensors in the sheet path. Downstream said sensors also detect and signal sheet path jams to controller 100 to start the operation of baffle system 11 as a cluster jam recovery site for all unjammed upstream sheets, which may be fed to stalled nip 16 and clustered in buckle chamber 30, for common removal.

Note that stopping the output rollers nip 15 or 16 with a sheet hanging out too far downstream may be undesirable, if the sheet could be extending sufficiently into the compiler tray to be engaged by an active compiler/jogger, or otherwise create problems. This is avoided with the present system.

In the schematic example here in FIG. 1 of a known "uphill" stacking sheet job set compiling and [optional] stapling (91) and ejecting system 90, the sequentially incoming undelayed sheets here are fed directly by nip 16 into the compiler/stapler unit 90, as shown by the sheet movement arrow. Sheets may be compiled in compiler tray 92 by dropping and being fed and registered against the stacking wall 92a of the compiling tray 92. During this set compiling and registration, a compiled set discharge member 93, comprising a set ejector drive roller, may be in a disengaged up position, as shown, not in contact with any of the sheets in the compiling tray 92. Once the incoming sheet has been discharged from the sheet entrance rolls and drops onto compiler tray 92, the top surface of the incoming sheet is then also contacted by a an active registration assistance system, here comprising a rotatably driven frictional flexible compiler registration jogger such as belt 95, causing the top sheet to be driven until it is fully registered against the wall 92a of the tray 92. This type of compressible open or "floppy belt" jogger for compiler assistance is further disclosed in Canon U.S. Pat. No. 4,883,265 (issued Nov. 28, 1989 to N. Iida, et al.); U.S. Pat. No. 5,137,265, and EP No. 0 346 851. Each subsequent sheet is compiled on top of the prior sheets on tray 92 in this manner. A conventional lateral registration tamper can also be provided, as in the cited or other art. That is, once each sheet is discharged and registered with the help of the rotation of the frictional floppy belts 95 against the topmost surface of the sheet in the compiling tray 92, a lateral tamper can engage to shift each sheet to a lateral registration edge of the tray 92. Because the floppy registration belts 95 are so flexible, and are held only at their top, they are easily deformed in the lateral direction. Alternatively, it Is also known for an active top sheet registration system such as 95 (or 86) to be at an angle, feeding incoming top sheets towards a registration corner, for positive 2-axis registration with one sheet registration feeder.

In the exemplary FIG. 2 compiler unit 80, stacking registration is assisted by another known type of rotatably driven active top compiler, here an elastomeric frictional fingers flapper/jogger 86, or the like. It is also acting directly on the top sheet, and indirectly on underlying sheets by inter-sheet friction. That type of compiler assistance 86 could alternatively be used in the system 90 of FIG. 1.

Once a fully compiled set is accumulated and stapled with registration alignment in compiler tray 92, a conventional powered stapler such as 91 may be actuated to fasten the set together. Then the set discharging member 93 is brought down to form a set ejecting nip with mating idler rollers 94 (shown near the outer end of compiler tray 92), to eject that finished set into a conventional (out square stacking) elevator/stacker unit 96 to squarely stack that set on top of the previous finished sets, as shown in FIG. 1, or other stacker. [This could alternatively be a designated user's bin of a plural bin shared user printer "mailboxing" unit.]

If no compiling or stapling is desired, ejector rollers 93 are held closed against rollers 94 to feed the output sheets directly on through the compiler unit 90 to stacker 96.

Note that during this compiling and finishing operation, the sheets may partially extend and hang out into an adjacent bin, or onto the top of the stack in stacker 96, saving overall compiler tray width. That is, the compiler tray 92 may be only a partial sheet supporting shelf for most sizes of sheets, as in the above-cited Mandel U.S. Pat. No. 5,098,074 or Canon U.S. Pat. No. 5,137,265; and/or Xerox Corporation U.S. Pat. No. 5,201,517, by Denis Stemmle, issued Apr. 13, 1993, entitled "Orbitting Nip Plural Mode Sheet Output With Faceup or Facedown Stacking". The latter is also an example of a compiler/stapler providing selectable faceup or facedown stacking with an integral inversion system.

If the compiler is an "uphill stacking" type such as 90 of FIG. 1, in which the incoming sheets slide back downstream in the compiler tray 92 to rear edge 92*a* register the previously trailing edges of the sheets, then it is preferable for the overlying sheet lead edge to lead slightly the underlying sheet of the sheet pair being ejected, for better registration as the active compiler 95 acts on the top sheet 20. If, however, as in FIG. 2, the compiler unit 80 with tray 82 is of the type which slopes downwardly away to provide "downhill" downstream stacking, in which the lead edges of the entering sheets register or align in the process direction against an outer registration edge (here a pivotal set ejection gate 84), then, in that type of system 80, preferably the top sheet lead edge slightly lags behind the bottom sheet of the incoming pair, for better active registration in that type of compiler. That is, insuring the positive compiler edge registration of the underlying sheet can be provided in "downhill" compiling (as in FIG. 2) if by the time both lead edges reach the final exit rollers 16, the underlying sheet lead edge slightly leads the overlapping sheet, instead of lagging, as shown for the system 90 of FIG. 1 for "uphill" compiling. In this way, in either type of compiler, the top-of-stack jogger acting on the topmost (second) sheet 20 as it comes into the compiler tray should also register the underlying first sheet 18.

To express it another way, in "uphill" stacking systems, the compiler registration edge is acting on what is the trailing edge of the ejecting sheets. In "downhill" stacking systems, the registration edge is the leading edge of the ejecting sheets. Whichever is the registration edge of the underlying sheet should extend out from under the registration edge of the overlying sheet, so that even if the sheets are partially stuck together (as by static electricity), or relatively slippery, the underlying sheet will hit the registration edge first, to insure registration, since the overlying sheet registration is assured by the positive top registration drive 95 or 86 acting directly thereon. That is, in all cases, the underlying sheet should hit the registration edge wall before the top sheet. Therefore, for "uphill" stacking as in compiler 90, the exiting underlying sheet lead edge should be slightly behind the overlying sheet lead edge, so that the underlying sheet trail edge at exit will extend beyond the overlying sheet trail edge, so that in the "uphill" compiler tray 92, the underlying sheet will register against wall 92*a* before the overlying sheet 20. (Of course, if there is an inverter or inversion path between this system and the compiler stacking, this desired sheet edge relationship will be reversed.)

As noted above, the FIG. 8 "prior art" drawing illustrates a present understanding of a reported prior art Eastman Kodak copier system 101 for also delaying sheet output between precollated sets being finished. As understood, the first sheet 102 is fed around a large diameter compliant driven roller 107, under a closely partially surrounding baffle 103, until that first sheet 102 is is stopped temporarily by a gate 104. Then the next or second sheet 105 is fed in through that same path under the stationary first sheet 102 until it also reaches gate 104, etc.. Then gate 104 opens and all sheets 102, 105, etc. are fed on to a compiler (not shown) by the nip between that large roller 107 and another set of rollers 106. As understood, this system 101 does not provide a direct or positive drive of the first sheet 102, (then separated from drive roller 107 by the second sheet 105) during initial ejection of the two sheets from gate 104, and depends on inter-sheet friction between these sheets to overcome the friction between sheet 102 and baffle 103, which is presumably substantially increased by the baffle 103 curvature for stiff sheets which resist bending to that curvature. It is also believed that this Kodak system is quite limited in the range of paper sizes it can handle.

The present system maintains positive, non-slip, feeder nip engagement of all sheets at all times. Furthermore, the present system does not at any time require two sheets to be simultaneously in the same path and nip while attempting to feed one sheet relative to the other, and then together, therein.

While the embodiment disclosed herein is preferred, it will be appreciated from this teaching that various alternatives, modifications, variations or improvements therein may be made by those skilled in the art, which are intended to be encompassed by the following claims:

What is claimed is:

1. For a reproduction apparatus feeding a sequential stream of printed copy sheets into a normal sheet path with a limited space and time therebetween, a sheet buffering system comprising:

a non-slip downstream sheet feeding nip normally feeding copy sheets downstream towards a sheet output in said normal sheet path;

said downstream sheet feeding nip being selectably intermittently temporarily stopped with a lead edge of a first copy sheet therein;

a sheet buckle chamber upstream of said downstream sheet feeding nip extending away from said normal sheet path;

a non-slip upstream sheet feeding nip positioned sufficiently closely to said downstream nip along said normal sheet path to simultaneously feed said first sheet in said upstream nip while a lead edge of the same sheet is in said downstream nip to drive the trail end of said first copy sheet into said buckle chamber when said downstream nip is so temporarily stopped, and to then feed a second copy sheet with said upstream nip in said normal sheet path past said first copy sheet in said buckle chamber to said downstream nip;

buckle-inducing sheet baffling in said normal sheet path between said upstream and downstream feeding nips; and said downstream nip then being automatically restarted upon said feeding of said second copy sheet thereto by said upstream nip to feed said first copy sheet from said buckle chamber in coordination with the feeding of said second copy sheet, so that both said first and second copy sheets are fed downstream by said downstream nip.

2. The sheet buffering system for a sequential stream of printed copy sheets of claim 1, wherein said normal sheet path is a sheet output path of said reproduction apparatus, and said reproduction apparatus is provided with a compiler/finisher fed by said output path and said downstream nip for repeatedly sequentially stacking said copy sheets in said compiler/finisher for compiling with edge registration and finishing of said stream of copy sheets into plural collated finished sets on-line as subsequent said copy sheets are being printed and outputted by said sheet output path of said reproduction apparatus, wherein said downstream feeding nip is intermittently temporarily stopped and restarted in coordination with the operation of said compiler/finisher on preceding copy sheets, and wherein said downstream sheet feeding nip is restarted to feed both said first and second sheets together downstream to said compiler/finisher with a substantial increase in the time between the feeding out of said first copy sheet by said downstream sheet feeding nip and preceding copy sheets so fed in said compiler/finisher.

3. The sheet buffering system for a sequential stream of printed copy sheets of wherein said first sheet is lapping said second sheet as they are so fed to said compiler/finisher by said downstream sheet feeding nip, by leading said second sheet at the edges of said first and second sheets which are being edge registered in said compiler/finisher.

4. The sheet buffering system for a sequential stream of printed copy sheets of wherein said normal sheet path is substantially planar and the trailing end of said first sheet is maintained substantially out of said planar normal sheet path in said buckle chamber as a subsequent sheet is fed downstream in said normal sheet path by said upstream nip.

5. The sheet buffering system for a sequential stream of printed copy sheets of claim 1, wherein said first sheet is overlying said second sheet as they are fed out by said downstream sheet feeding nip, with the leading edge of the overlying said first sheet extending out ahead of the underlying said second sheet.

6. The sheet buffering system for a sequential stream of printed copy sheets of claim 1, wherein the normal printing order of said first and second sheets is reversed.

7. The sheet buffering system for a sequential stream of printed copy sheets of claim 6, wherein said sheet buckle chamber extends above said normal sheet path.

8. The sheet buffering system for a sequential stream of printed copy sheets of claim 1, wherein said sheets are fed by said downstream sheet feeding nip to a compiler tray with edge registration with said first sheet slightly shingled relative to said second sheet for edge registration in said compiler tray.

9. The sheet buffering system for a sequential stream of printed copy sheets of claim 8, wherein the trailing edge of said second sheet fed into said compiler tray by said downstream nip for uphill compiling is underlying said first sheet and following the trailing edge of said first sheet.

10. The sheet buffering system for a sequential stream of printed copy sheets of claim 1, wherein said sheet buffering system provides a plural sheet stopping and collection point in said buckle chamber for stopping and collecting plural said copy sheets fed from upstream thereof rather than feeding said plural sheets further downstream in the normal sheet path.

11. The sheet buffering system for a sequential stream of printed copy sheets of claim 1, wherein said am nip comprises a rotating upstream sheet feeder, and wherein the trail ends of buckled copy sheets are stripped off of said upstream sheet feeder by a mating baffle, which mating baffle then holds said trail end away from said upstream sheet feeding nip.

12. The sheet buffering system for a sequential stream of printed copy sheets of claim 1, wherein said sheet buckle chamber extends above said normal sheet path.

13. The sheet buffering system for a sequential stream of printed copy sheets of claim 1, wherein said sheet buckle chamber extends below said normal sheet path.

14. The sheet buffering system for a sequential stream of printed copy sheets of claim 1, wherein said upstream feeding nip is adopted to engage and drive said trail end of the first sheet into said buckle chamber.

* * * * *